US008731422B2

(12) United States Patent
Tanaka et al.

(10) Patent No.: US 8,731,422 B2
(45) Date of Patent: May 20, 2014

(54) IMAGE FORMING APPARATUS AND METHOD FOR RE-EXECUTING DUPLEX PRINTING

(75) Inventors: Hiromasa Tanaka, Shizuoka-ken (JP); Eiichi Yamanishi, Kanagawa-ken (JP); Hiroyuki Okuyama, Kanagawa-ken (JP); Tetsuya Sadowara, Shizuoka-ken (JP); Yoshihito Hiroe, Shizuoka-ken (JP); Yasuaki Okamoto, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 418 days.

(21) Appl. No.: 13/150,673

(22) Filed: Jun. 1, 2011

(65) Prior Publication Data

US 2011/0299867 A1 Dec. 8, 2011

Related U.S. Application Data

(60) Provisional application No. 61/350,655, filed on Jun. 2, 2010.

(51) Int. Cl.
*G03G 15/16* (2006.01)
*G03G 15/20* (2006.01)

(52) U.S. Cl.
USPC ..... 399/66; 399/68

(58) Field of Classification Search
USPC ..... 399/66, 68, 374, 364
See application file for complete search history.

(56) References Cited

FOREIGN PATENT DOCUMENTS

| | | | | | |
|---|---|---|---|---|---|
| JP | 05088435 | A | * | 4/1993 | ..... G03G 15/00 |
| JP | 06027774 | A | * | 2/1994 | ..... G03G 15/00 |
| JP | 07049634 | A | * | 2/1995 | ..... G03G 15/20 |
| JP | 2008-287177 | | | 11/2008 | |

* cited by examiner

*Primary Examiner* — Billy Lactaoen
(74) *Attorney, Agent, or Firm* — Amin, Turocy & Watson, LLP

(57) ABSTRACT

According to one embodiment, an image forming apparatus includes: a first paper feeding unit; a second paper feeding unit; a fixing unit configured to fix a developer image transferred onto a sheet; a conveying path configured to convey sheets; a receiving unit configured to receive an execution instruction for duplex printing for continuously printing an image on one surface and on the other surface of a sheet; an acquiring unit configured to acquire, in the printing on one surface, information concerning presence or absence of an image on the other surface; and a processor configured to change, in the printing on one surface, if a result of the acquisition concerning the sheet fed from the first paper feeding unit indicates that an image is present, a paper feeding unit from the first paper feeding unit to the second paper feeding unit and performs control for re-executing the duplex printing.

20 Claims, 5 Drawing Sheets

IMAGE FORMING APPARATUS AND METHOD FOR RE-EXECUTING DUPLEX PRINTING

CROSS-REFERENCE TO RELATED APPLICATION

This application is also based upon and claims the benefit of priority from U.S. provisional application 61/350,655, filed on Jun. 2, 2010; the entire contents of which are incorporated herein by reference.

FIELD

Embodiments described herein relate generally to a technique for performing duplex printing in an image forming apparatus.

BACKGROUND

In the past, when duplex printing is performed, if a sheet is reverse side paper, the duplex printing is performed on the reverse side paper in a superimposing manner. Therefore, printing is repeated or sheets are wasted.

DETAILED DESCRIPTION

In general, according to one embodiment, an image forming apparatus includes: a first paper feeding unit; a second paper feeding unit; a fixing unit configured to fix a developer image transferred onto a sheet; a conveying path configured to convey sheets from the first paper feeding unit and the second paper feeding unit to the fixing unit; a receiving unit configured to receive an execution instruction for duplex printing for continuously executing a first operation for printing an image on one surface of a sheet and a second operation for printing an image on the other surface; an acquiring unit configured to acquire, in the first operation in the duplex printing, information concerning presence or absence of an image on the other surface of the sheet conveyed through the conveying path; and a processor configured to change, in the first operation in the duplex printing, if a result of the acquisition by the acquiring unit concerning the sheet fed from the first paper feeding unit indicates that an image is present, a paper feeding unit from the first paper feeding unit to the second paper feeding unit and performs control for re-executing the duplex printing.

Figure 1:
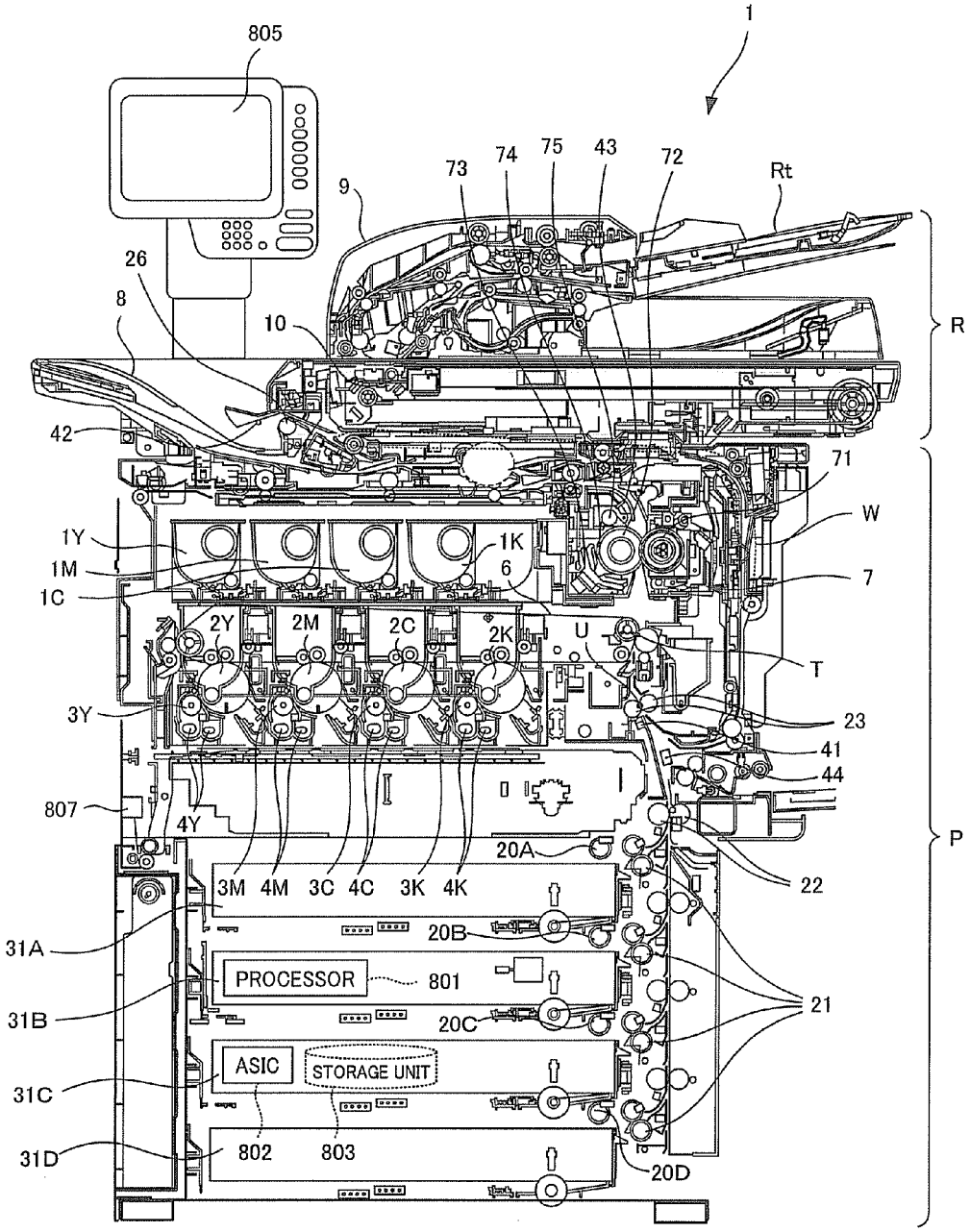
FIG. 1 is a sectional view of an image forming apparatus.

FIG. 1 is a sectional view of an image forming apparatus according to an embodiment. Referring to FIG. 1, an image forming apparatus 1 includes an image reading section R and an image forming section P. The image reading section R scans and reads images of a sheet document and a book document.

The image forming section P forms a developer image on a sheet on the basis of an image read from an original document by the image reading section R or printing data transmitted to the image forming apparatus 1 by an external apparatus.

The image reading section R includes an auto document feeder (ADF) 9 configured to automatically feed the original document to a predetermined image reading position. The image reading section R reads, with a scanning optical system 10, an image of the original document automatically fed by the auto document feeder 9 and placed on a document tray Rt or an image of an original document placed on a document table.

The image forming section P includes toner cartridges 1Y to 1K, photoconductive members 2Y to 2K, developing rollers 3Y to 3K, mixers 4Y to 4K, an intermediate transfer belt 6, a fixing device 7, cassette trays 31 (first to fourth cassette trays 31A to 31D), and a discharge tray 8.

The first cassette tray 31A, the second cassette tray 31B, the third cassette tray 31C, and the fourth cassette tray 31D are located side by side in the up-down direction. Sheets of the same size are stacked in the first cassette tray 31A and the second cassette tray 31B. The sheets stacked in the first cassette tray 31A are picked up by a first pickup roller 20A one by one. The sheets stacked in the second cassette tray 31B are picked up by a second pickup roller 20B one by one. Sheets stacked in the third cassette tray 31C are picked up by a third pickup roller 20C one by one. Sheets stacked in the fourth cassette tray 31D are picked up by a fourth pickup roller 20D one by one. The sheets picked up by the pickup rollers 20A to 20D are conveyed to registration rollers 23 according to rotation of first conveying rollers 21 and second conveying rollers 22.

The registration rollers 23 correct a tilt of a sheet conveyed to a secondary transfer position T where a toner is intermediately transferred by the intermediate transfer belt 6. Specifically, when the sheet comes into contact with the registration rollers 23, the tilt of the sheet is corrected.

A registration sensor 41 detects the size of the sheet that comes into contact with the registration rollers 23. A detection system may be an optical system. The registration sensor 41 is turned on when the registration sensor 41 detects the sheet. The registration sensor 41 is turned off when the registration sensor 41 ceases to detect the sheet.

A reverse-side-paper detection sensor 44 acquires, in a position between the second conveying rollers 22 and the registration rollers 23, information for discriminating whether an image is formed on a rear surface of the sheet. The reverse-side-paper detection sensor 44 may be a photo-sensor of a reflection type. A processor 801 discriminates, on the basis of the intensity of a light receiving signal of the photo-sensor, whether the sheet is reverse side paper. The rear surface of the sheet means a surface on the opposite side of a surface onto which a developer image is transferred in the secondary transfer position T.

The fixing device 7 includes a pressing roller 71, a heating roller 72, a heating unit 73, a heating belt 74, and a stretching and suspending roller 75. The pressing roller 71 rotates while being in contact with the heating belt 74. The heating roller 72, the heating belt 74, and the stretching and suspending roller 75 rotate following the pressing roller 71. The heating unit 73 includes a coil. A magnetic flux is generated by a high-frequency current applied to the coil. The magnetic flux generated by the heating unit 73 induces an eddy-current in the heating belt 74. The heating belt 74 generates heat. A fixing sensor 43 detects a sheet that finishes passing a nip unit between the pressing roller 71 and the heating roller 72. A detection system may be an optical system.

A discharge roller 26 discharges the sheet on which a developer image is fixed in the fixing device 7 to the discharge tray 8. The sheet discharged from the discharge roller 26 is detected by a discharge sensor 42.

The image forming apparatus 1 according to this embodiment includes the processor 801, an ASIC 802, a storage unit 803, an operation display unit 805, and a communication unit 807. The processor 801 has a role of performing various kinds of processing in the image forming apparatus 1. The processor 801 also has a role of realizing various functions by executing a computer program stored in the storage unit 803. The processor 801 may be a CPU or an MPU. The processor 801 may include the ASIC 802. In this case, the ASIC 802 executes, in a circuit manner, at least a part of processing realized by the processor 801. The storage unit 803 may be, for example, a RAM (Random Access Memory), a ROM (Read Only Memory), a DRAM (Dynamic Random Access Memory), or an SRAM (Static Random Access Memory). The storage unit 803 stores various kinds of information required when acts of flowcharts explained later are executed.

Various settings are displayed on the operation display unit 805. The various settings are changed by operating the operation display unit 805. The operation display unit 805 may be a touch panel type. The communication unit 807 receives a signal transmitted from a PC mounted with a printer driver.

As an example of processing in the image forming apparatus according to this embodiment, an operation in executing and processing duplex printing is explained. In this example, a sheet is picked up from the first cassette tray 31A.

First, the sheet picked up from the first cassette tray 31A by the first pickup roller 20A is conveyed to the registration rollers 23 according to rotation of the first conveying roller 21 and the second conveying rollers 22. The first conveying roller 21, the second conveying rollers 22, the registration rollers 23, and the like form a sheet conveying path extending from the paper feeding unit to the fixing device 7.

Images of plural sheet documents continuously automatically fed by the auto document feeder 9 are read by the scanning optical system 10 in the predetermined image reading position.

On the basis of printing data of images read from the original documents in the image reading section R, electrostatic latent images are formed on photoconductive surfaces of the photoconductive members 2Y, 2M, 2C, and 2K for transferring developer images of yellow (Y), magenta (M), cyan (C), and black (K) onto the sheet.

Subsequently, developers agitated by the mixers 4Y to 4K in a developing device are supplied to the photoconductive members 2Y to 2K, on which the electrostatic latent images are formed as explained above, by the developing rollers 3Y to 3K. Consequently, the electrostatic latent images formed on the photoconductive surfaces of the photoconductive members are visualized.

Developer images formed on the photoconductive members are transferred onto a belt surface of the intermediate transfer belt 6 (so-called primary transfer). The developer images carried by rotation of the intermediate transfer belt 6 are transferred onto a front surface of the sheet conveyed from the registration rollers 23 in the secondary transfer position T.

The developer images transferred onto the front surface of the sheet are heated and fixed on the sheet by the fixing device 7. The sheet having the developer images heated and fixed thereon is switched back to a duplex printing path W indicated by a dotted line and conveyed to the registration rollers 23. At this point, the rear surface of the sheet is located on a side facing the intermediate transfer belt 6. When the registration rollers 23 further rotate, the images are transferred onto the rear surface of the sheet in the secondary transfer position T. The developer images transferred onto the rear surface of the sheet are heated and fixed on the sheet by the fixing device 7 and then discharged onto the discharge tray 8 by plural conveying roller pairs.

Figure 2:
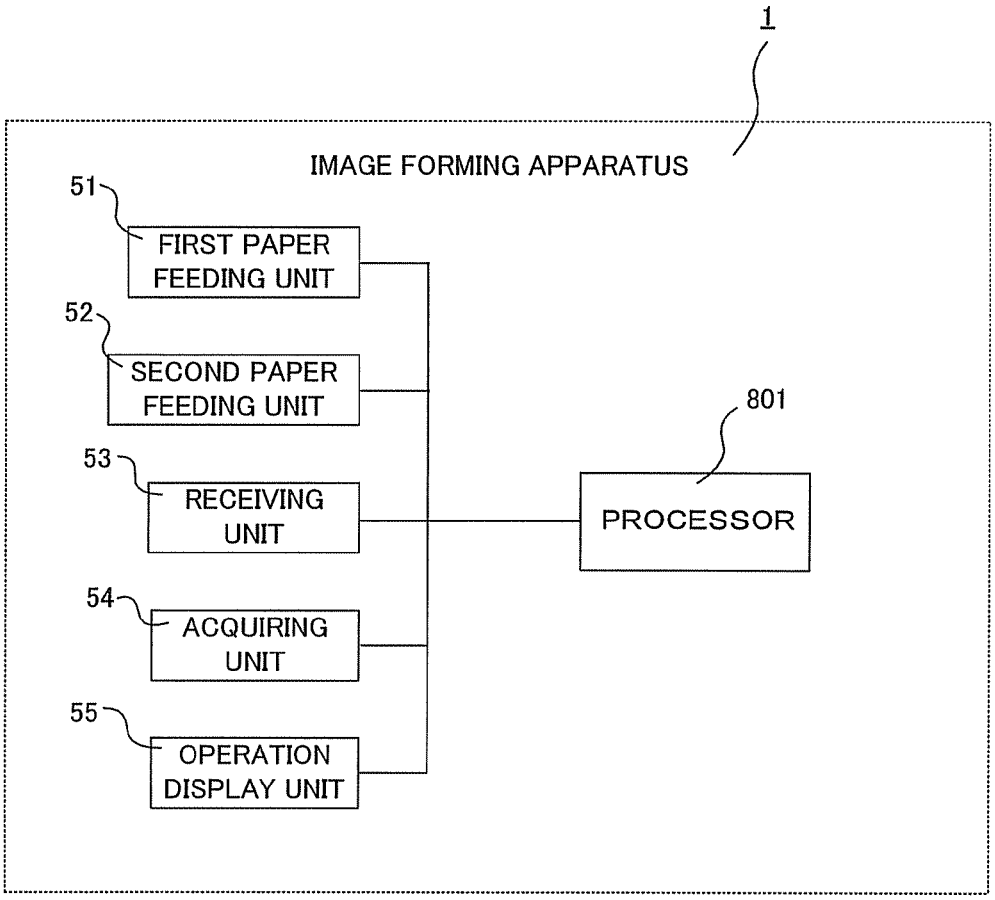
FIG. 2 is a functional block diagram of the image forming apparatus.

An example of functional blocks of the image forming apparatus according to this embodiment is shown in FIG. 2. The image forming apparatus 1 according to this embodiment includes a first paper feeding unit 51 and a second paper feeding unit 52. The first paper feeding unit 51 and the second paper feeding unit 52 may be respectively the first cassette tray 31A and the second cassette tray 31B. The first paper feeding unit 51 and the second paper feeding unit 52 may be respectively the second cassette tray 31B and the first cassette tray 31A.

A receiving unit 53 receives an execution instruction concerning duplex printing for continuously executing a first operation for printing an image on one surface of a sheet and a second operation for printing an image on the other surface. The first operation means an operation of the image forming section P performed after a sheet stacked in a cassette tray is picked up by a pickup roller until fixing processing by the fixing device 7 is completed. The second operation means an operation of the image forming section P performed after the sheet is switched back to the duplex printing path W until the fixing processing by the fixing device 7 is completed.

The receiving unit 53 may be the operation display unit 805. A user instructs execution of duplex printing by operating the operation display unit 805. The receiving unit 53 may be the communication unit 807. If the duplex printing is instructed from an external apparatus (e.g., a PC of the user) via a printer driver, the communication unit 807 receives a signal of the instruction.

In the first operation in the duplex printing, an acquiring unit 54 acquires information concerning presence or absence of an image on the rear surface of the sheet conveyed through a conveying path. The acquiring unit 54 may be the reverse-side-paper detection sensor 44. In the first operation in the duplex printing, if the acquiring unit 54 discriminates that the sheet fed from the first paper feeding unit 51 is reverse side paper, the processor 801 changes the paper feeding unit from the first paper feeding unit 51 to the second paper feeding unit 52 and performs control for re-executing the duplex printing. Specifically, if a sheet fed from the first paper feeding unit 51 is reverse side paper, the processor 801 controls the image forming section P such that a developer image same as a developer image primarily transferred onto a front surface of the sheet is formed on the intermediate transfer belt 6 again. The developer image formed on the intermediate transfer belt 6 again is transferred onto a front surface of a sheet fed from the second paper feeding unit 52.

Different developer images are continuously formed on the intermediate transfer belt 6 on the basis of order of images read by the image reading section R. Therefore, in order to form the same developer image to be interposed among these different developer images, it is necessary to detect reverse side paper earlier. In this embodiment, since reverse side paper is detected in a position further upstream than the registration rollers 23, a temporal margin for performing the interposing formation is secured.

When the acquiring unit 54 discriminates whether the sheet fed from the paper feeding unit is reverse side paper, the processor 801 may store information concerning whether the sheet fed from the paper feeding unit is reverse side paper. If the processor 801 stores the information concerning whether the sheet fed from the paper feeding unit is reverse side paper, when the next and subsequent duplex printing operations are performed, it is possible to automatically select, on the basis of the information stored by the processor 801, the paper feeding unit that can perform duplex printing. It is unnecessary to perform the operation explained above every time. If the paper feeding unit is opened and closed, the stored information needs to be reset. This is because, if the paper feeding unit is opened once, it is likely that the sheet is changed.

If a sheet fed from the second paper feeding unit 52 is also reverse side paper, the processor 801 displays, on the operation display unit 805, as a selection screen, a simplex printing screen for printing an image only on the front surface of the sheet and a cancel screen for canceling the printing. At this point, the processor 801 temporarily stops the image forming section P.

If simplex printing is selected in the selection screen, the processor 801 executes simplex printing for applying printing only to the front surface of the sheet fed from the first paper feeding unit 51 or simplex printing for maintaining the second paper feeding unit 52 as the paper feeding unit and applying printing only to the front surface of the sheet fed from the second paper feeding unit 52. If cancellation is selected in the selection screen, the processor 801 discards image data read in the image reading section R.

Figure 3:
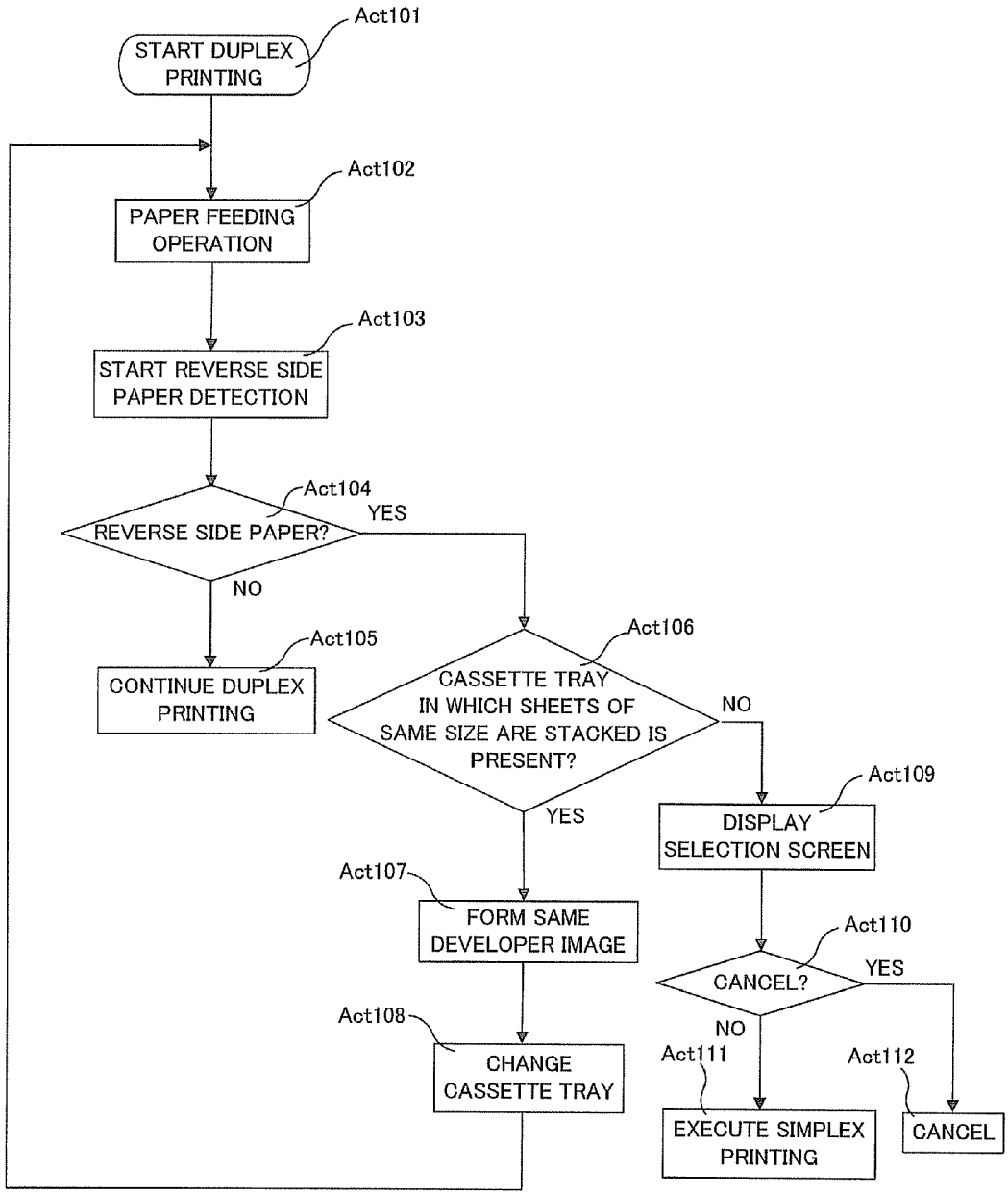
FIG. 3 is a flowchart for explaining acts during duplex printing of the image forming apparatus.

Acts during duplex printing of the image forming apparatus are explained with reference to a flowchart of FIG. 3. In the flowchart, it is assumed that the first cassette tray 31A is selected as the paper feeding unit. In Act 101, the user instructs the duplex printing. In Act 102, the processor 801 picks up, with the first pickup roller 20A, a sheet stacked in the first cassette tray 31A and controls driving of the first conveying roller 21 and the second conveying rollers 22 to thereby convey the picked-up sheet to a registration position U.

In Act 103, the reverse-side-paper detection sensor 44 starts acquisition of discrimination information for discriminating whether an image is formed on the rear surface of the sheet. In Act 104, the processor 801 discriminates, on the basis of an output signal output by the reverse-side-paper detection sensor 44, whether the sheet is reverse side paper. If it is discriminated in Act 104 that the sheet is not reverse side paper, the processor 801 proceeds to Act 105. If it is discriminated in Act 104 that the sheet is reverse side paper, the processor 801 proceeds to Act 106.

In Act 105, the processor 801 continues the duplex printing. If a first sheet fed from the first cassette tray 31A is not reverse side paper, empirically, it is highly likely that other sheets following the first sheet are not reverse side paper either. If a sheet picked up first is not reverse side paper, the duplex printing is continued, whereby the duplex printing using sheets that are not reverse side paper is executed without complicating control during the duplex printing.

In Act 106, the processor 801 discriminates presence or absence of another cassette tray in which sheets having a size same as the size of the sheets stacked in the first cassette tray 31A are stacked. If there is such another cassette tray, the processor 801 proceeds to Act 107. If there is no such another cassette tray, the processor 801 proceeds to Act 109.

In Act 107, the processor 801 controls the image forming section P to thereby form, on the intermediate transfer belt 6, a developer image same as a developer image transferred onto the front surface of the sheet discriminated as reverse side paper. In Act 108, the processor 801 changes the paper feeding unit from the first cassette tray 31A to the second cassette tray 31B and returns to Act 102. The processor 801 discharges the sheet discriminated as reverse side paper to the discharge tray 8 after fixing processing in the fixing device 7. At this point, the processor 801 may control rotating speed of the discharge roller 26 such that the sheet discriminated as reverse side paper and the sheet subjected to the duplex printing are discharged to different positions on the discharge tray 8. Therefore, distinction of the sheet discriminated as reverse side paper and the sheet subjected to the duplex printing is simplified.

In Act 109, the processor 801 displays the selection screen on the operation display unit 805. If "cancel" in the selection screen is selected in Act 110, the processor 801 proceeds to Act 112. If "cancel" is not selected, the processor 801 proceeds to Act 111. In Act 111, the processor 801 switches a printing mode from the duplex printing to simplex printing and executes the simplex printing. The paper feeding unit in executing the simplex printing may be the first cassette tray 31A or the second cassette tray 31B. In Act 112, the processor 801 stops a printing operation for all images read in the image reading section R.

According to the flowchart, if reverse side paper is included in sheets stacked in a cassette tray, the paper feeding unit is automatically changed to a cassette tray in which reverse side paper is not included. The duplex printing is completed.

Modification 1

A sheet of reverse side paper subjected to printing processing on the sheet front surface during the duplex printing may be conveyed to an erasing unit. The erasing unit may be the fixing device 7. Immediately after the reverse-side-paper detection sensor 44 detects reverse side paper, the processor 801 raises the temperature of the fixing device 7 to erasing temperature higher than fixing temperature and erases a developer image formed on a sheet that enters the fixing device 7 from the secondary transfer position T. The processor 801 discharges the sheet from which the developer image is erased to the discharge tray 8. The erasing unit may be a component different from the fixing device 7. According to this modification, a waste of sheets is reduced.

Modification 2

In the embodiment explained above, the dimensions of the sheets respectively stacked in the first paper feeding unit 51 and the second paper feeding unit 52 are the same. However, the dimensions may be different dimensions. In this case, if a sheet fed from the first paper feeding unit 51 is reverse side paper, a sheet having a size different from the size of the sheets stacked in the first paper feeding unit 51 is fed from the second paper feeding unit 52. The processor 801 executes the duplex printing on the sheet fed from the second paper feeding unit 52. Specifically, in Act 106 in the flowchart of FIG. 3, the processor 801 searches for another cassette tray irrespective of the size of the sheet. The other cassette tray may be selected according to order set in advance. The processor 801 reads out, from the storage unit 803, information concerning the selection order of cassette trays and executes the duplex printing. The user may select the other cassette tray. The processor 801 executes the duplex printing on sheets stacked in the cassette tray selected by the user.

Modification 3

In the embodiment explained above, the first paper feeding unit 51 and the second paper feeding unit 52 are respectively the first cassette tray 31A and the second cassette tray 31B. However, the combination of the first paper feeding unit 51 and the second paper feeding unit 52 and the first cassette tray 31A and the second cassette tray 31B may be another combination. In the other combination, the first paper feeding unit 51 may be the first cassette tray 31A and the second paper feeding unit 52 may be an option tray located on a side of the cassette trays 31A to 31D. Sheets are fed from the option tray to the conveying path of the image forming apparatus 1 when a residual amount of sheets stored in the first cassette tray 31A is small. If a sheet fed from the first cassette tray 31A is reverse side paper, the processor 801 executes the duplex printing on a sheet fed from the option tray.

The present invention can be carried out in various forms without departing from the spirit and the main characteristics of the present invention. Therefore, the embodiment is merely an example in every aspect and should not be limitedly interpreted. The scope of the present invention is indicated by the scope of the claims and is by no means limited by the text of the specification. Further, all modifications and various alterations, substitutions, and improvements belonging to the scope of equivalents of the claims are within the scope of the present invention.

Reference Example 1

Figure 4:
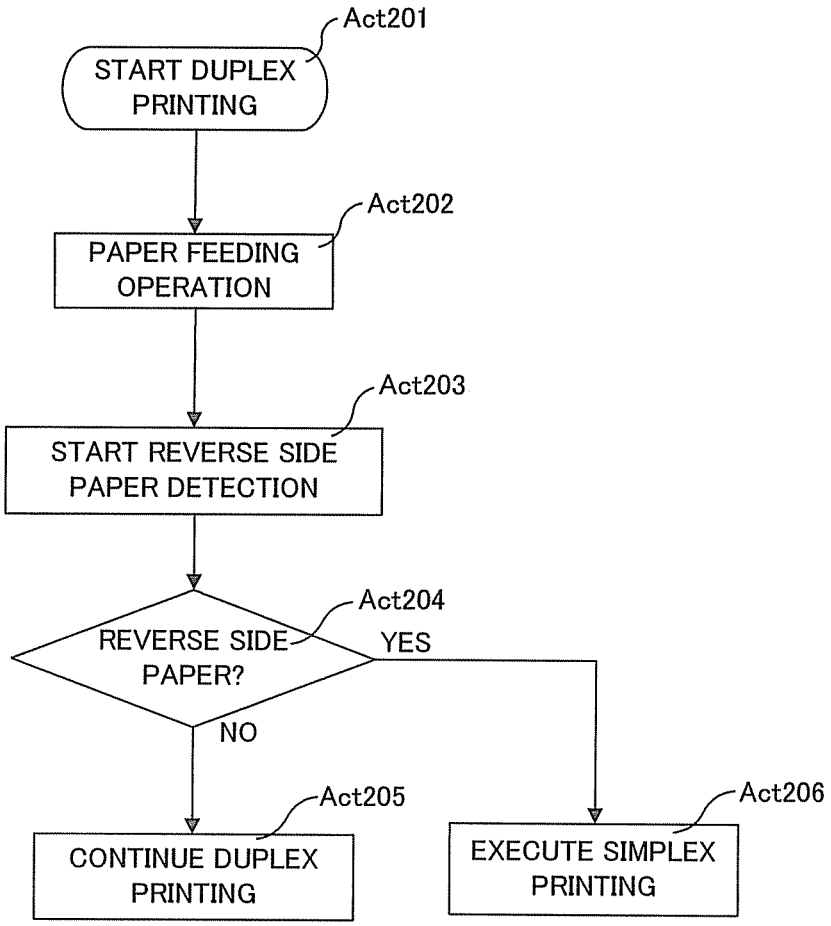
FIG. 4 is a flowchart for explaining acts during duplex printing of an image forming apparatus according to a reference example 1.

A reference example 1 of the image forming apparatus according to this embodiment is explained below with reference to a flowchart of FIG. 4. In Act 201, a user instructs duplex printing. In Act 202, the processor 801 picks up, with the first pickup roller 20A, a sheet stacked in the first cassette tray 31A and controls driving of the first conveying roller 21 and the second conveying rollers 22 to thereby convey the picked-up sheet to the registration position U.

In Act 203, the reverse-side-paper detection sensor 44 starts acquisition of discrimination information for discriminating whether an image is formed on the rear surface of the sheet. In Act 204, the processor 801 discriminates, on the basis of ah output signal output by the reverse-side-paper detection sensor 44, whether the sheet is reverse side paper. If it is discriminated in Act 204 that the sheet is not reverse side paper, the processor 801 proceeds to Act 205. If it is discriminated in Act 204 that the sheet is reverse side paper, the processor 801 proceeds to Act 206.

In Act 205, the processor 801 continues the duplex printing. In Act 206, the processor 801 switches a printing mode from the duplex printing to simplex printing and executes a printing operation. Since execution of the duplex printing on reverse side paper is prohibited, labor and time of the user for reprinting is saved and a waste of sheets is prevented.

Reference Example 2

Figure 5:
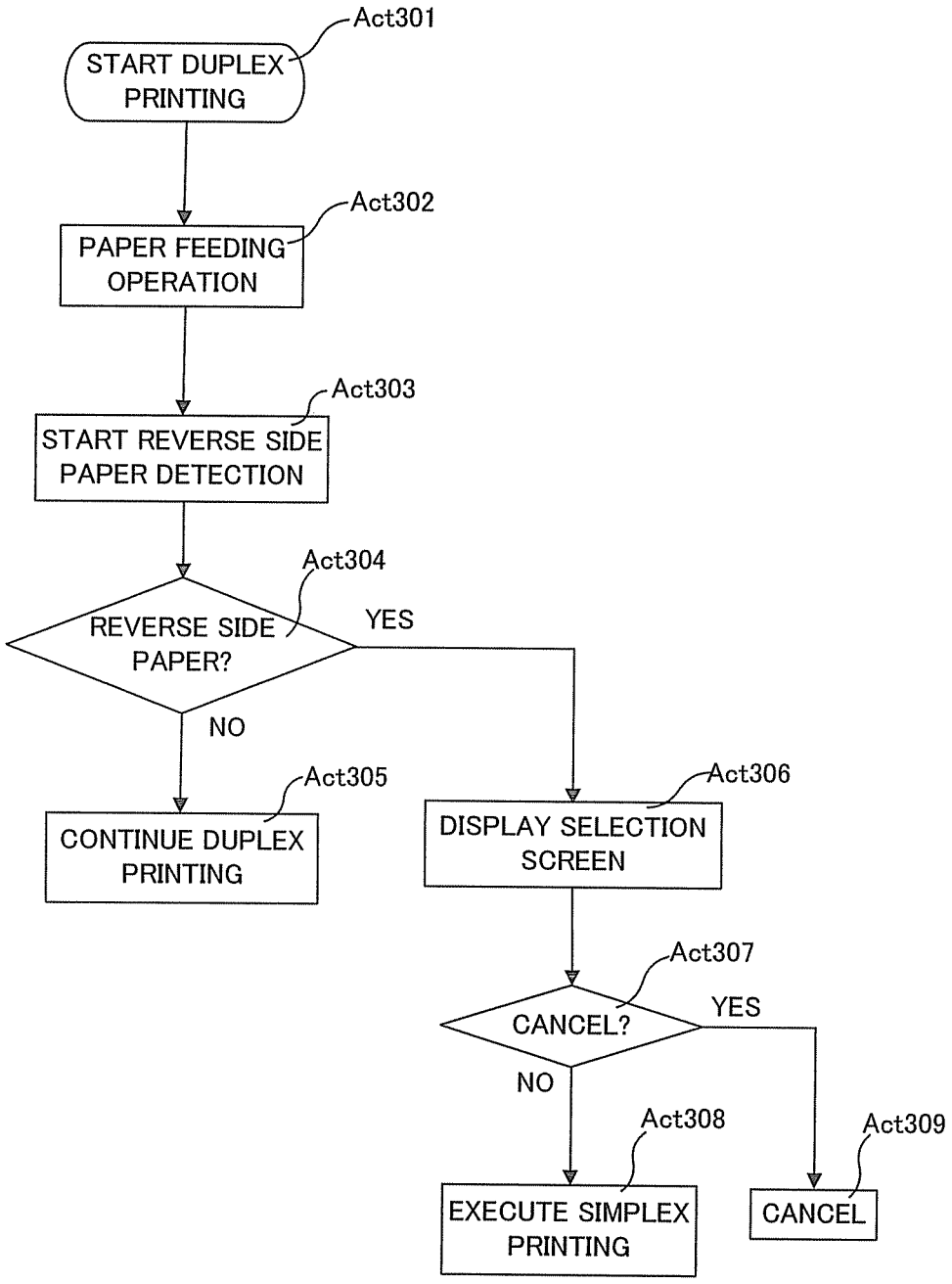
FIG. 5 is a flowchart for explaining acts during duplex printing of an image forming apparatus according to a reference example 2.

A reference example 2 of the image forming apparatus according to this embodiment is explained with reference to a flowchart of FIG. 5. In Act 301, the user instructs the duplex printing. In Act 302, the processor 801 picks up, with the first pickup roller 20A, a sheet stacked in the first cassette tray 31A and controls driving of the first conveying roller 21 and the second conveying rollers 22 to thereby convey the picked-up sheet to the registration position U.

In Act 303, the reverse-side-paper detection sensor 44 starts acquisition of discrimination information for discriminating whether an image is formed on the rear surface of the sheet. In Act 304, the processor 801 discriminates, on the basis of an output signal output by the reverse-side-paper detection sensor 44, whether the sheet is reverse side paper. If it is discriminated in Act 304 that the sheet is not reverse side paper, the processor 801 proceeds to Act 305. If it is discriminated in Act 304 that the sheet is reverse side paper, the processor 801 proceeds to Act 306.

In Act 305, the processor 801 continues the duplex printing. In Act 306, the processor 801 displays the selection screen on the operation display unit 805. If "cancel" in the selection screen is selected in Act 307, the processor 801 proceeds to Act 309. If "cancel" is not selected, the processor 801 proceeds to Act 308. In Act 308, the processor 801 switches a printing mode from the duplex printing to simplex printing and executes the simplex printing. The paper feeding unit in executing the simplex printing may be the first cassette tray 31A or the second cassette tray 31B. In Act 309, the processor 801 stops a printing operation for all images read in the image reading section R.

Since execution of the duplex printing on reverse side paper is prohibited, labor and time of the user for reprinting is saved and a waste of sheets is prevented.

What is claimed is:

1. An image forming apparatus comprising:

a first paper feeding unit;

a second paper feeding unit;

a fixing unit configured to fix a developer image transferred onto a sheet;

a conveying path configured to convey sheets from the first paper feeding unit and the second paper feeding unit to the fixing unit;

a receiving unit configured to receive an execution instruction for duplex printing for continuously executing a first operation for printing an image on one surface of a sheet and a second operation for printing an image on the other surface;

an acquiring unit configured to acquire, in the first operation in the duplex printing, information concerning presence or absence of an image on the other surface of the sheet conveyed through the conveying path; and a processor configured to change, in the first operation in the duplex printing, if a result of the acquisition by the acquiring unit concerning the sheet fed from the first paper feeding unit indicates that an image is present, a paper feeding unit from the first paper feeding unit to the second paper feeding unit and performs control for re-executing the duplex printing, wherein the first paper feeding unit and the second paper feeding unit feed sheets of sizes different from each other.

2. The apparatus according to claim 1, further comprising a transfer unit configured to transfer a developer image onto the sheet conveyed through the conveying path, wherein the acquiring unit acquires the information concerning presence or absence of an image in a position further on an upstream side in a conveying direction of the sheet than the transfer unit.

3. The apparatus according to claim 1, wherein the sheet concerning which the result of the acquisition by the acquiring unit indicates that an image is present is conveyed to an erasing unit without an image being printed on the other surface.

4. The apparatus according to claim 3, wherein the fixing unit serves as the erasing unit as well and heats the sheet to temperature equal to or higher than erasing temperature for a toner.

5. The apparatus according to claim 1, further comprising a display unit, wherein when the duplex printing is re-executed, if a result of acquisition by the acquiring unit concerning a sheet fed from the second paper feeding unit indicates an image is present, the processor displays, on the display unit, a selection screen for causing a user to select one of simplex printing and printing cancellation.

6. An image forming apparatus comprising:
a first paper feeding unit;
a second paper feeding unit;
a fixing unit configured to fix a developer image transferred onto a sheet;
a conveying path configured to convey sheets from the first paper feeding unit and the second paper feeding unit to the fixing unit;
a receiving unit configured to receive an execution instruction for duplex printing for continuously executing a first operation for printing an image on one surface of a sheet and a second operation for printing an image on the other surface;
an acquiring unit configured to acquire, in the first operation in the duplex printing, information concerning presence or absence of an image on the other surface of the sheet conveyed through the conveying path;
a processor configured to change, in the first operation in the duplex printing, if a result of the acquisition by the acquiring unit concerning the sheet fed from the first paper feeding unit indicates that an image is present, a paper feeding unit from the first paper feeding unit to the second paper feeding unit and performs control for re-executing the duplex printing; and
a transfer unit configured to transfer a developer image onto the sheet conveyed through the conveying path, wherein
in the first operation in the duplex printing, if the result of the acquisition by the acquiring unit concerning the sheet fed from the first paper feeding unit indicates that an image is present, the transfer unit transfers, onto a sheet fed from the second paper feeding unit, a developer image same as a developer image transferred onto the sheet fed from the first paper feeding unit.

7. The apparatus according to claim 6, wherein the sheet concerning which the result of the acquisition by the acquiring unit indicates that an image is present is discharged after fixing processing in the fixing unit without an image being printed on the other surface.

8. The apparatus according to claim 6, wherein the first paper feeding unit and the second paper feeding unit feed sheets of a same size.

9. The apparatus according to claim 6, wherein the acquiring unit is an optical sensor.

10. The apparatus according to claim 6, wherein the sheet concerning which the result of the acquisition by the acquiring unit indicates that an image is present is conveyed to an erasing unit without an image being printed on the other surface.

11. A control method for an image forming apparatus, comprising:
conveying a sheet from a first paper feeding unit to a fixing unit during duplex printing;
acquiring, in the conveying, information concerning presence or absence of an image on a rear surface of the sheet conveyed from the first paper feeding unit to the fixing unit;
changing, if a result of the acquisition in the acquiring indicates that an image is present, a paper feeding unit from the first paper feeding unit to a second paper feeding unit different from the first paper feeding unit; and
re-executing the duplex printing on a sheet fed from the second paper feeding unit to which the paper feeding unit is changed in the changing,
wherein the first paper feeding unit and the second paper feeding unit feed sheets of sizes different from each other.

12. The method according to claim 11, wherein the sheet concerning which the result of the acquisition in the acquiring indicates that an image is present is subjected to erasing without an image being printed on the other surface.

13. The method according to claim 12, wherein the fixing unit executing the erasing for heating the sheet to temperature equal to or higher than erasing temperature for a toner.

14. An image forming apparatus comprising:
a first paper feeding unit;
a second paper feeding unit;
a fixing unit configured to fix a developer image transferred onto a sheet;
a conveying path configured to convey sheets from the first paper feeding unit and the second paper feeding unit to the fixing unit;
a receiving unit configured to receive an execution instruction for duplex printing for continuously executing a first operation for printing an image on one surface of a sheet and a second operation for printing an image on the other surface;
an acquiring unit configured to acquire, in the first operation in the duplex printing, information concerning presence or absence of an image on the other surface of the sheet conveyed through the conveying path; and
a processor configured to change, in the first operation in the duplex printing, if a result of the acquisition by the acquiring unit concerning the sheet fed from the first paper feeding unit indicates that an image is present, a paper feeding unit from the first paper feeding unit to the second paper feeding unit and performs control for re-executing the duplex printing,
wherein information concerning the result of the acquisition by the acquiring unit is stored until a paper feeding unit is opened and closed, and the processor automatically selects, during next and subsequent duplex printing operations, the paper feeding unit on the basis of the stored information.

15. A control method for an image forming apparatus, comprising:
conveying a sheet from a first paper feeding unit to a fixing unit during duplex printing;
acquiring, in the conveying, information concerning presence or absence of an image on a rear surface of the sheet conveyed from the first paper feeding unit to the fixing unit;
changing, if a result of the acquisition in the acquiring indicates that an image is present, a paper feeding unit from the first paper feeding unit to a second paper feeding unit different from the first paper feeding unit; and
re-executing the duplex printing on a sheet fed from the second paper feeding unit to which the paper feeding unit is changed in the changing,
wherein information concerning the result of the acquisition in the acquiring is stored until a paper feeding unit is opened and closed, and, during next and subsequent duplex printing operations, the paper feeding unit is automatically selected on the basis of the stored information.

16. The method according to claim 15, wherein the acquiring is executed in a position further on an upstream side in a conveying direction of the sheet than a transfer position where a developer image is transferred onto the sheet.

17. The method according to claim 15, wherein the sheet concerning which the result of the acquisition in the acquiring indicates that an image is present is discharged after fixing processing in the fixing unit without an image being printed on the other surface.

18. The method according to claim 15, wherein the first paper feeding unit and the second paper feeding unit feed sheets of a same size.

19. The method according to claim 15, further comprising executing, when the duplex printing is re-executed, if a result of acquisition in the acquiring concerning a sheet fed from the second paper feeding unit indicates an image is present, one of simplex printing and printing cancellation.

20. The method according to claim 15, wherein the sheet concerning which the result of the acquisition in the acquiring indicates that an image is present is subjected to erasing without an image being printed on the other surface.

* * * * *